US005639259A

United States Patent [19]

Wellinsky

[11] Patent Number: 5,639,259

[45] Date of Patent: Jun. 17, 1997

[54] STRAIN RELIEF FOR ELECTRICAL CABLE

[75] Inventor: Wayne T. Wellinsky, Moore, S.C.

[73] Assignee: Thomas & Betts Corporation, Memphis, Tenn.

[21] Appl. No.: 347,030

[22] Filed: Nov. 30, 1994

[51] Int. Cl.[6] ..... H01R 13/58

[52] U.S. Cl. ..... 439/470

[58] Field of Search ..... 439/470, 467, 439/456, 472, 474, 449, 404, 405, 417, 493

[56] References Cited

U.S. PATENT DOCUMENTS

| | | | |
|---|---|---|---|
| 2,099,610 | 11/1937 | Ledder | 173/328 |
| 2,728,061 | 12/1955 | Bliss et al. | 339/196 |
| 2,981,918 | 4/1961 | Gluck et al. | 339/103 |
| 3,034,091 | 5/1962 | Gluck | 339/103 |
| 4,025,142 | 5/1977 | Huber et al. | 339/128 |
| 4,351,579 | 9/1982 | Kordes et al. | 339/14 |
| 4,358,172 | 11/1982 | Narozny | 439/493 |
| 4,538,873 | 9/1985 | Worth | 339/99 |
| 4,804,342 | 2/1989 | Rudy, Jr. et al. | 439/467 |
| 5,011,430 | 4/1991 | Haitmanek | 439/456 |
| 5,266,048 | 11/1993 | Brekosky et al. | 439/470 |

*Primary Examiner*—P. Austin Bradley
*Assistant Examiner*—Yong Kim
*Attorney, Agent, or Firm*—Michael L. Hoelter; Salvatore J. Abbruzzese

[57] ABSTRACT

An electrical cable strain relief comprises a body defining an elongate panel with latching legs depending from the panel at longitudinally opposed margins thereof, the body having folded portions at laterally opposed margins of the panel, the folded portions extending laterally interiorly of the laterally opposed margins of the panel. The strain relief includes projections or like spacing structure depending from the undersurface of the panel for spacing the folded portions from the undersurface of the panel to facilitate manufacture and cleaning of the strain relief. Where facility for both daisy-chain and end of line applications is desired, the strain relief of the invention includes an elongate slot in the panel thereof and further folded portions at laterally opposed margins of the opening extending laterally exteriorly of the opening.

18 Claims, 7 Drawing Sheets

STRAIN RELIEF FOR ELECTRICAL CABLE

BACKGROUND OF THE INVENTION

This invention relates generally to relieving strain on electrical cables and pertains more particularly to strain relief for flat multiconductor cables and electrical connections with connectors thereof.

FIELD

Known strain reliefs for flat multiconductor cables are shown, for example, in U.S. Pat. Nos. 4,025,142 and 4,538,873, to comprise a flat panel and latching legs depending from the panel. The latching legs define latching projections at their free ends and the connector to which the strain relief is applied has counterpart detent structure for releasably retaining the latching projections. Alternatively, the latching projections may straddle a connector and be retained by detent structure in a printed circuit board (PCB), thus serving both strain relief and securement of a terminated cable and connector to a PCB. In either instance, the cable which the connector terminates is secured beneath the strain relief panel.

The '873 patent provides an elongate slot in the strain relief panel, permitting use of the strain relief in either daisy-chain or end-of-line applications.

SUMMARY OF THE INVENTION

The present invention has as its primary object the provision of improved strain reliefs for flat multiconductor cable and electrical connections therewith.

In attaining the above and other objects, the invention provides an electrical cable strain relief comprising a body defining an elongate panel with latching legs depending from the panel at longitudinally opposed margins thereof, the body having folded portions at laterally opposed margins of the panel, the folded portions extending laterally interiorly of the laterally opposed margins of the panel.

The folded portions, with the panel proper, provide a double-thickness feature for the strain relief, enhancing its ability to resist bending.

The strain relief desirably includes projections or like spacing structure depending from the undersurface of the panel for spacing the folded portions from the undersurface of the panel to facilitate manufacture and cleaning of the strain relief.

Where facility for both daisy-chain and end-of-line applications is desired, the strain relief of the invention includes the above-noted elongate slot in the panel thereof. However, in such instance, the strain relief includes further folded portions at laterally opposed margins of the opening and extending laterally exteriorly of the opening.

In a particularly preferred embodiment, the strain relief of the invention provides for the folded portions and the further folded portions both to abut the projections depending from the strain relief panel, whereby all folded portions are spaced from the undersurface of the panel. The folded portions may be of equal length laterally of the strain relief with the projections disposed laterally midwise of the slot margins and the outer lateral margins of the strain relief.

The foregoing and other objects and features of the invention will be further understood from the following detailed discussion of preferred practices and embodiments thereof and from the drawings wherein like reference numerals identify like components and part throughout.

DETAILED DESCRIPTION OF THE PREFERRED EMBODIMENT

Figure 1:
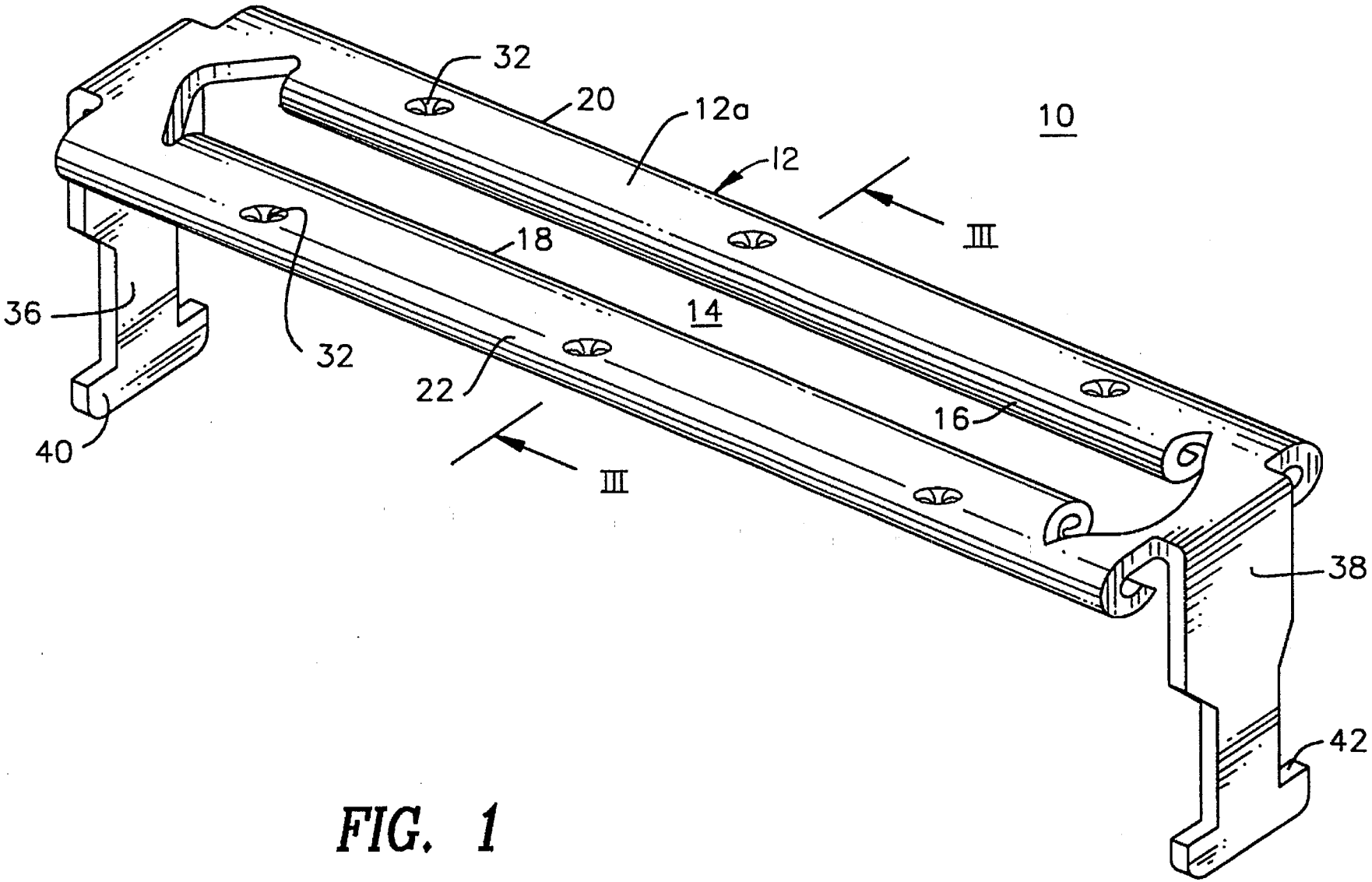
FIG. 1 is a perspective view of a strain relief in accordance with the invention in an upright condition.
Figure 2:
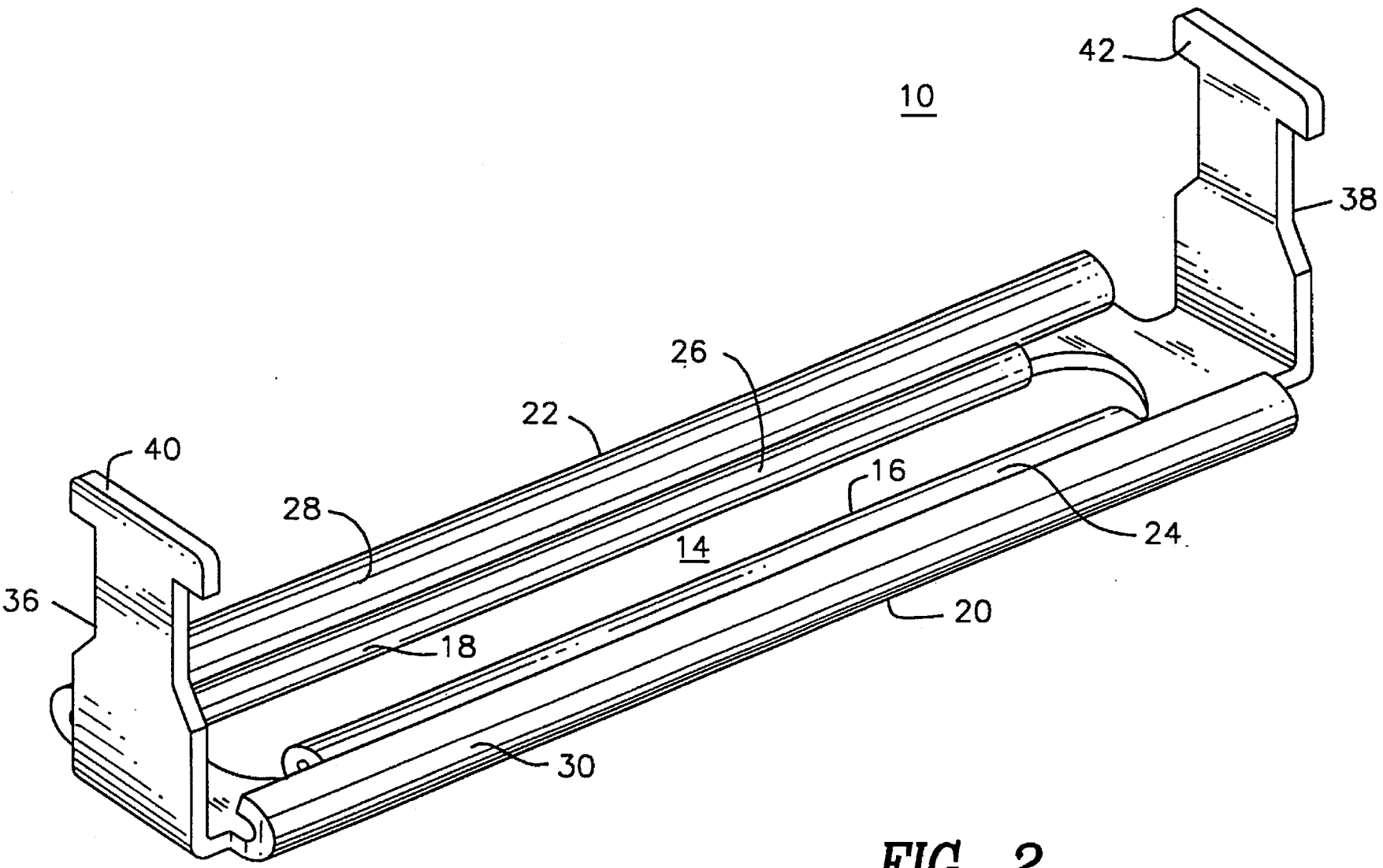
FIG. 2 is a perspective view of the FIG. 1 strain relief in inverted condition.
Figure 3:
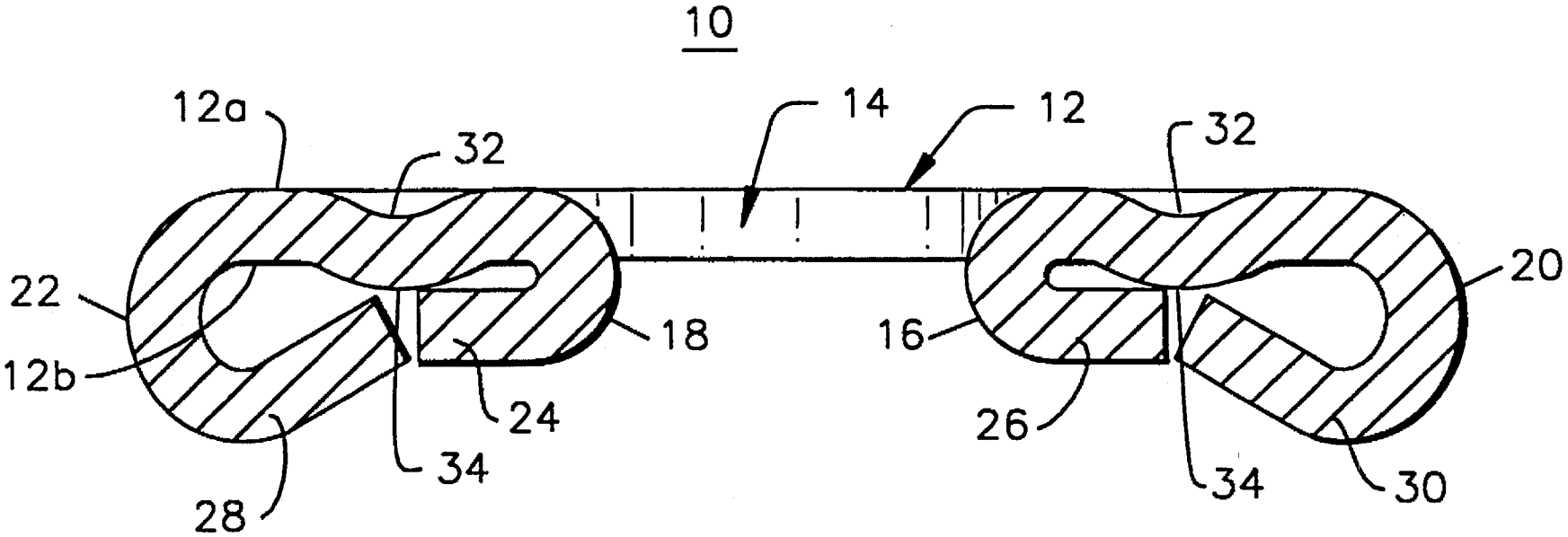
FIG. 3 is a sectional view as would be seen from plane III—III of FIG. 1 of the panel of the strain relief, with latching leg 36 omitted from the showing.

Referring to FIGS. 1–3, strain relief 10 of the invention is a one-piece body having elongate top panel 12 with respective top surface 12*a* and undersurface 12*b*. Slot opening 14 extends longitudinally of and depthwise through top panel 12 and is bounded by top panel interior margins 16 and 18. Exterior margins of top panel 12 are identified as 20 and 22.

Folded portions 24 and 26 are provided adjacent margins 16 and 18 and extend laterally exteriorly of strain relief 10. Folded portions 28 and 30 are provided adjacent margins 20 and 22 and extend laterally interiorly of strain relief 10.

Indentations 32 are formed in top panel surface 12*a* and result in dimple-like projections 34 extending downwardly of top panel surface 12*b*. The projections are effective in defining a mutual spacing as between the folded portions 24, 26,28 and 30 and surface 12*b* of top panel 12.

Latching legs 36 and 38 depend from top panel 12 and define latching projections 40 and 42.

In the embodiment of FIGS. 1–3, strain relief 10 has its interior folded portions 24 and 26 and its further or exterior folded portions 28 and 30 all in abutting relation to projections 34, whereby all folded portions are spaced from undersurface 12*b*. The folded portions may be of substantially equal length laterally of strain relief 10. Projections 34 are disposed substantially laterally midwise of the slot margins 16 and 18 and the outer lateral margins 20 and 22.

As is seen in FIGS. 1–3, folded portions 24 and 26 give rise to rounded laterally interior structure for strain relief 10 bounding slot 14 and folded portions 28 and 30 give rise to rounded laterally exterior structure for strain relief 10, thus providing smooth cable contact surfaces in use of the strain relief in both daisy-chain and end-of-line applications. Further, the folded portions give rise to doubled material thickness to enhance rigidity in the strain relief, i.e., increased strength in resisting bending. The presence of projections 34 affords a substantial open area in the strain relief between the top panel and the folded portions, providing ready draining of fluids in the course of manufacture and for in-use cleaning thereof.

Figure 4:
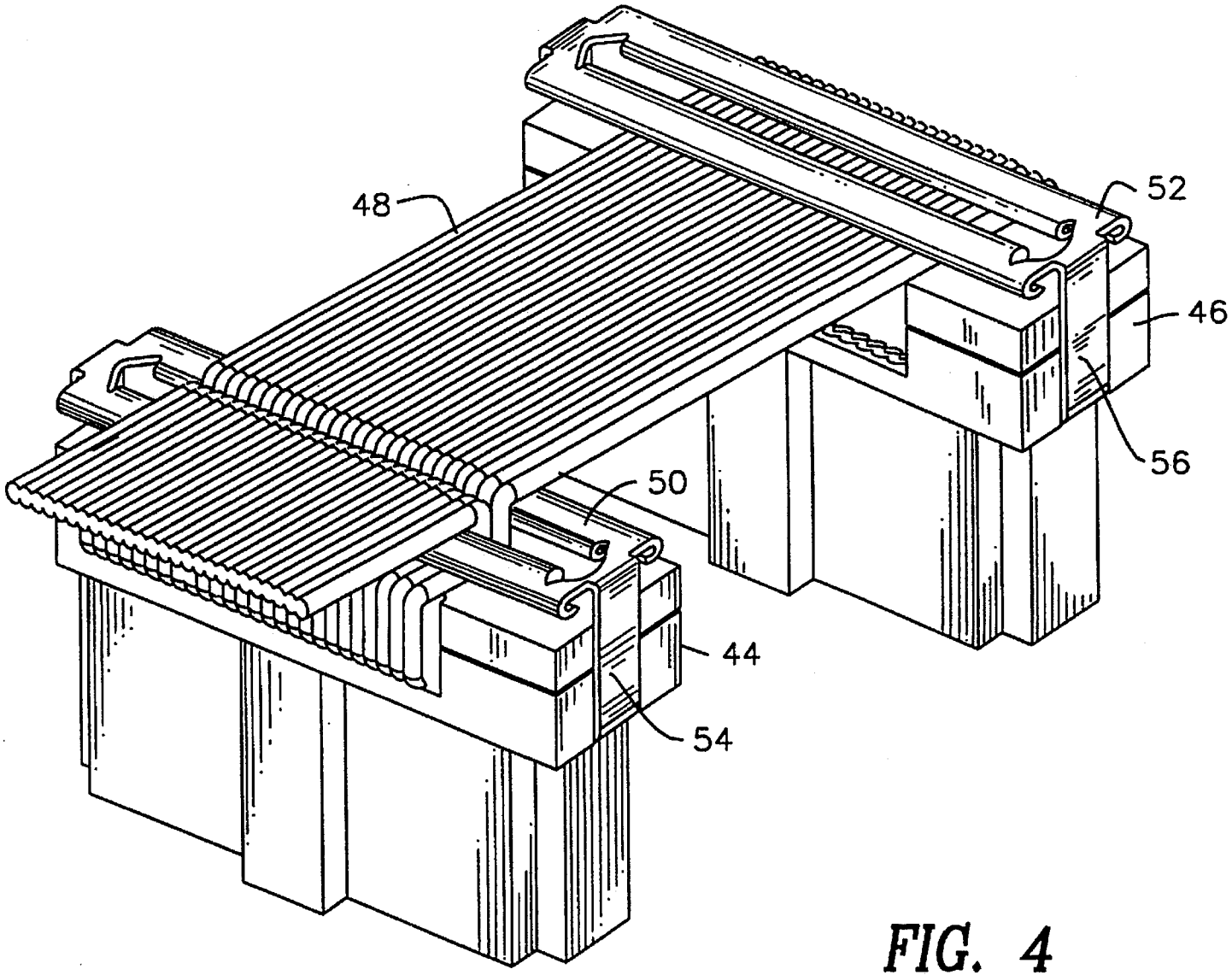
FIG. 4 is a perspective view of a further strain relief in accordance with the invention applied to multiconductor cable being terminated in daisy-chain and end-of-line applications.

Turning to FIG. 4, connectors 44 and 46 are shown respectively in daisy-chain and end-of-line termination of multiconductor cable 48. Strain reliefs 50 and 52 are shown as applied respectively to connectors 44 and 46 and in strain-relieving relation to cable 48. Strain reliefs 50 and 52 have top panels of the type employed in strain relief 10, but have differently-configured latching legs 54 and 56, the free end latching projections of which extend longitudinally into connector side recesses. Connectors 44 and 46 have insulation displacing contacts (not shown) for terminating conductors of cable 48, such as are illustrated in the above-referenced strain relief patents.

Figure 5:
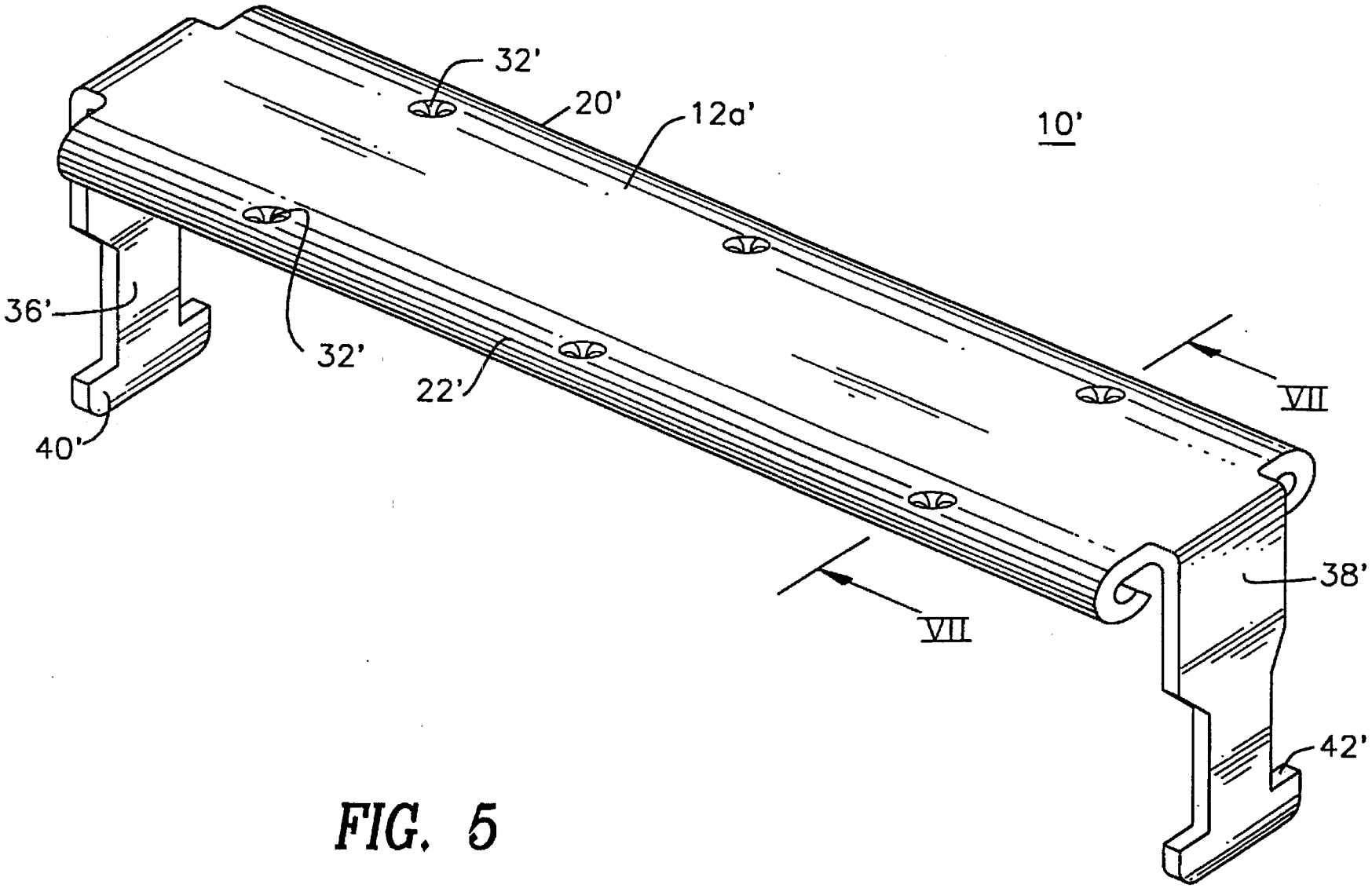
FIG. 5 is a perspective view of a further strain relief in accordance with the invention in an upright condition.
Figure 6:
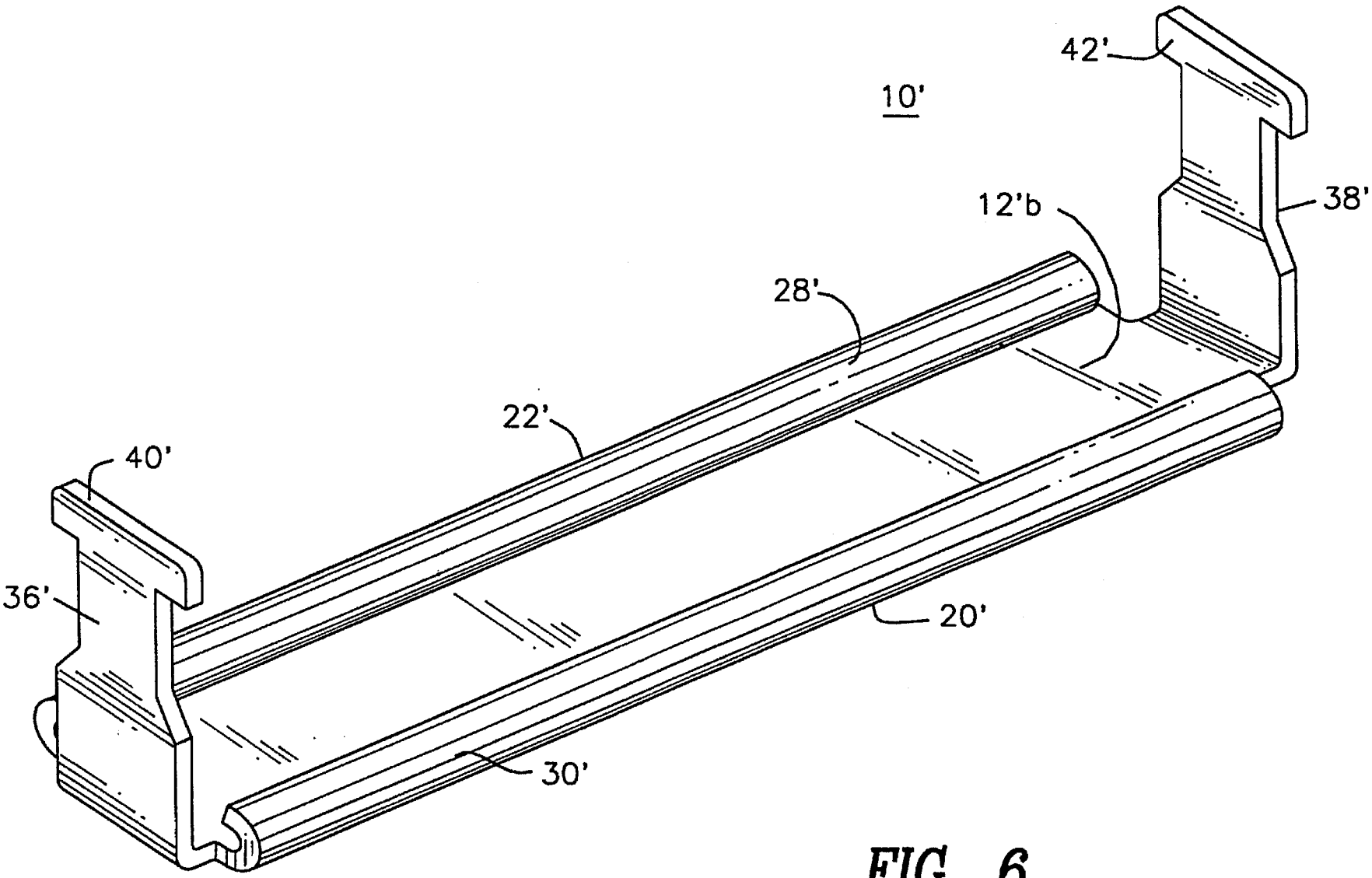
FIG. 6 is a perspective view of the FIG. 5 strain relief in inverted condition.
Figure 7:
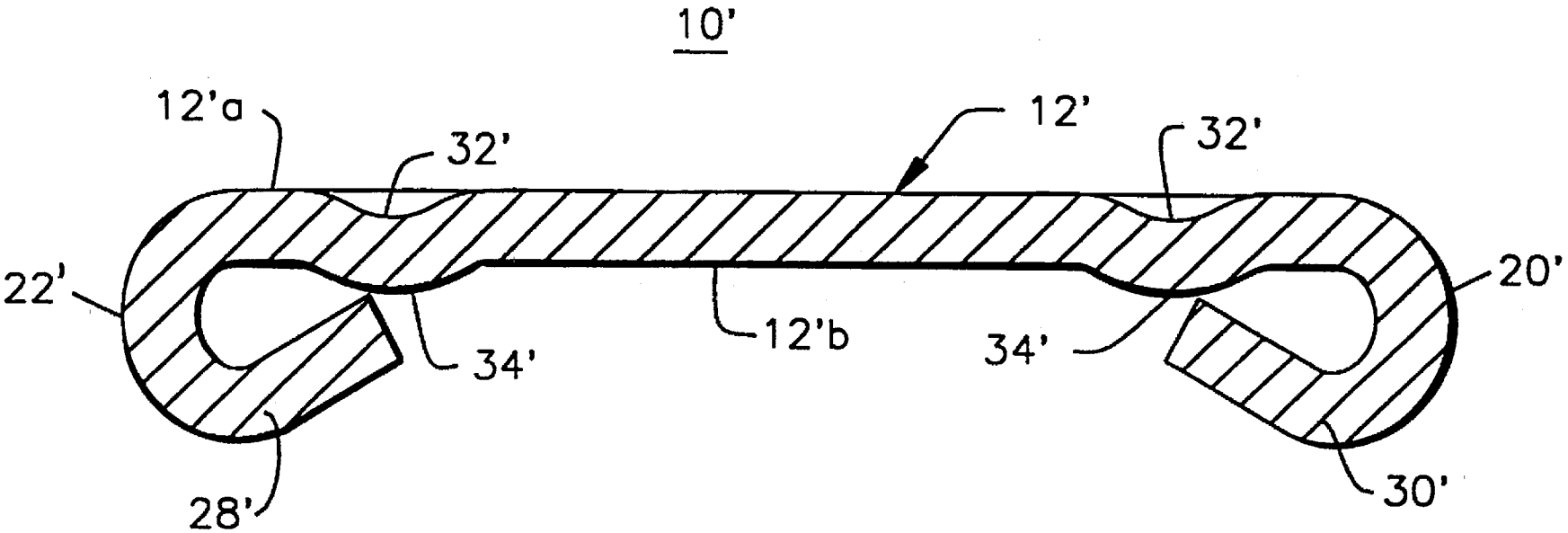
FIG. 7 is a sectional view as would be seen from plane VII—VII of FIG. 5 of the panel of the strain relief, with latching leg 36' omitted from the showing.

FIGS. 5–7 depict strain relief 10', which has unslotted top panel 12', and is adapted for use in end-of-line cable terminating applications. Primed reference numerals have correspondence with non-primed reference numerals in FIGS. 1–3.

In fabricating strain relief 10, a sheet material is cut to define intended top panel 12 with portions 28 and 30 extending laterally outwardly of intended top panel 12 in the plane thereof, with intended latching legs 36 and 38 extending longitudinally outwardly of intended top panel 12, and a central slit made longitudinally of intended top panel 12. Latching leg expanse of the sheet material is bent generally orthogonally of the intended top panel. The intended top panel 12 is then dimpled to form projections 34 and the intended folded portions are folded into dispositions above discussed and illustrated.

Various changes to the particularly disclosed strain reliefs and practices may evidently be introduced without departing from the invention. Accordingly, it is to be appreciated that the particularly discussed and depicted embodiments and practices of the invention are intended in an illustrative and not in a limiting sense. The true spirit and scope of the invention are set forth in the ensuing claims.

What is claimed is:

1. An electrical cable strain relief comprising a body defining an elongate panel with latching legs depending from said panel at longitudinally opposed ends thereof, said body having folded portions at laterally opposed side edges of said panel, said folded portions extending laterally interiorly of said laterally opposed side edges along an undersurface of said panel, wherein said body defines means for spacing said folded portions from the undersurface of said panel and the folded portion provides a substantially rounded surface along the underside of the elongate body for contacting an electrical cable for providing strain relief.

2. The electrical cable strain relief claimed in claim 1, wherein an upper surface of said panel is dimpled to provide projections at said undersurface of said panel, said projections constituting said means for spacing said folded portions from said undersurface of said panel.

3. The electrical cable strain relief claimed in claim 1, wherein said folded portions are of substantially equal length.

4. The electrical cable strain relief claimed in claim 1, wherein said body has an elongate opening extending therethrough laterally interiorly of said laterally opposed margins of said panel.

5. The electrical cable strain relief claimed in claim 4, wherein said body has further folded portions at laterally opposed margins of said opening extending laterally exteriorly of said opening.

6. The electrical cable strain relief claimed in claim 5, wherein said body defines means for spacing said folded portions and said further folded portions from an undersurface of said panel.

7. The electrical cable strain relief claimed in claim 6, wherein an upper surface of said panel is dimpled to provide projections at said undersurface of said panel, said projections constituting said means for spacing said folded portions and said further folded portions from said undersurface of said panel.

8. The electrical cable strain relief claimed in claim 5, wherein said further folded portions are of substantially equal length.

9. The electrical cable strain relief claimed in claim 5, wherein said folded portions and said further folded portions are of substantially equal length.

10. An electrical cable strain relief comprising:

an elongate body having opposed longitudinal ends;

a pair of latching legs depending from the body at opposite longitudinal ends thereof;

wherein the elongate body includes an upper surface, and an undersurface and opposed side walls having edge portions, each edge portion having a folded portion, the folded portion being fixedly folded interiorly from each edge portion of the opposed sidewalls of the elongate body along the undersurface thereof, the folded portion providing a substantially rounded surface along the undersurface of the elongate body for contacting an electrical cable for providing strain relief.

11. The electrical cable strain relief claimed in claim 10, wherein an upper surface of the body is dimpled to provide projections at an undersurface of the body, said projections providing a means for spacing said folded portions from said undersurface of the body.

12. The electrical cable strain relief claimed in claim 10, wherein said folded portions are of substantially equal length.

13. The electrical cable strain relief claimed in claim 10, wherein said body has a centrally located elongate opening extending therethrough.

14. The electrical cable strain relief claimed in claim 10, wherein said body includes further folded portions, the further folded portions being folded exteriorly from edges which defines said opening and are parallel to the edge portions of the sidewalls.

15. The electrical cable strain relief claimed in claim 14, wherein an upper surface of the body is dimpled to provide projections at an undersurface of the body, said projections providing a means for spacing said folded portions and said further folded portions from said undersurface of the body.

16. The electrical cable strain relief claimed in claim 14, wherein said further folded portions are of substantially equal length.

17. The electrical cable strain relief claimed in claim 14, wherein said folded portions and said further folded portions are of substantially equal length.

18. The electrical cable strain relief claimed in claim 10, wherein the body is formed from sheet metal which is bent to form the latching legs and folded portions.

* * * * *